United States Patent [19]

McDaniel

[11] Patent Number: 4,458,442

[45] Date of Patent: Jul. 10, 1984

[54] GLIDER WITH ADJUSTABLE WINGS

[76] Inventor: Don W. McDaniel, 9133 Outinda, Spring Valley, Calif. 92077

[21] Appl. No.: 483,934

[22] Filed: Apr. 11, 1983

[51] Int. Cl.[3] ..... A63H 27/00

[52] U.S. Cl. ..... 446/66

[58] Field of Search ..... 46/79, 1 J, 81, 76 R, 46/74 R, 78, 1 L

[56] References Cited

U.S. PATENT DOCUMENTS

| | | | |
|---|---|---|---|
| 1,792,779 | 2/1931 | Tarr | 46/79 |
| 2,168,653 | 8/1939 | Meagher, Jr. | 46/79 |
| 2,343,710 | 3/1944 | Russell | 46/79 |
| 2,351,504 | 6/1944 | Guillow | 46/79 |
| 2,505,541 | 5/1950 | Guillow | 46/79 |
| 2,724,211 | 11/1955 | Bloom | 46/79 |
| 2,825,179 | 3/1958 | Ferlen | 46/79 |
| 3,366,354 | 1/1968 | Sterba | 46/79 X |
| 3,540,149 | 11/1970 | Lowe | 46/79 |
| 3,778,926 | 12/1973 | Gladych | 46/79 |
| 4,103,454 | 8/1978 | Stone | 46/79 |

*Primary Examiner*—Mickey Yu

*Attorney, Agent, or Firm*—Brown & Martin

[57] ABSTRACT

A hand launched glider of folded sheet material, having a basic fuselage with integral tail surfaces and a curved slot to hold a wing which is keyed to the fuselage to maintain alignment, the wing being adjustable fore and aft in the slot. The central fuselage and nose portion are reinforced by additional folded elements, one of the elements comprising a slidable locking member which secures the wing at any selected position in the slot. A spring clip on the nose secures the multiple elements in place, including the wing locking member, and also serves as ballast for balancing the glider. The wing and tail have adjustable control surfaces which, together with the wing position adjustment, provide a wide range of flight control.

7 Claims, 6 Drawing Figures

GLIDER WITH ADJUSTABLE WINGS

BACKGROUND OF THE INVENTION

Small hand or catapult launched gliders of the simple toy variety have been made from a variety of materials, such as paper, plastic, wood and the like. Usually the body or fuselage is a flat or folded element with a slot to hold a wing, and with tail elements either integral or inserted in other slots. In some configurations the wing is flat and is held in a straight slot, which may be longer than the central chord of the wing to allow for forward and aft adjustment of the wing. In other types the slot may be curved to hold a camber in the wing for increased lift and may also have clearance for wing adjustment. All of these can be adjusted to vary the performance but have one common disadvantage. After each flight it is usually necessary to readjust the settings because the wing is moved out of position by the landing shock, by a collision with some object, or even by the inertia of the launch. Thus the performance is not entirely predictable from one flight to the next. Also, the typical toy glider is rather flimsy and the nose in particular is quickly damaged or distorted.

SUMMARY OF THE INVENTION

The glider described herein is made from sheet material cut and folded to shape, with reinforcing elements in the nose and other portions subject to damage. The fuselage has a curved slot to receive a wing, the slot being of sufficient length to allow forward and aft adjustment. One of the reinforcing elements in the fuselage is a slidable member which straddles the wing and locks the wing in any preset position in the slot, the assembly being locked in place by a clip which serves as nose ballast. The wing has alignment elements which are keyed to the fuselage and hold the fuselage in a rigid assembly. Tail surfaces are integral with the rear portion of the fuselage and are bent into position.

The wing and tail have control surface portions which can be individually bent to provide a variety of aerodynamic configurations to preset the flight characteristics. The structure is preferably of reasonably stiff thin sheet material such as plastic, plastic coated paper, card stock, or the like, which will hold its shape and maintain the settings of the control surfaces. In the central and nose portions of the fuselage multiple layers are used for strength, the various portions, including the wing locking member, being secured by a nose clip which also serves as ballast.

The primary object of this invention, therefore, is to provide a new and improved hand launched glider.

Another object of this invention is to provide a hand launched glider with an adjustable wing which can be locked in any preset position.

A further object of this invention is to provide a hand launched glider which is adjustable to a wide range of performance characteristics and is reinforced at critical points to withstand prolonged use.

Other objects and advantages will be apparent in the following detailed description, taken in conjunction with the accompanying drawings, in which.

DESCRIPTION OF THE PREFERRED EMBODIMENT

Figure 3:
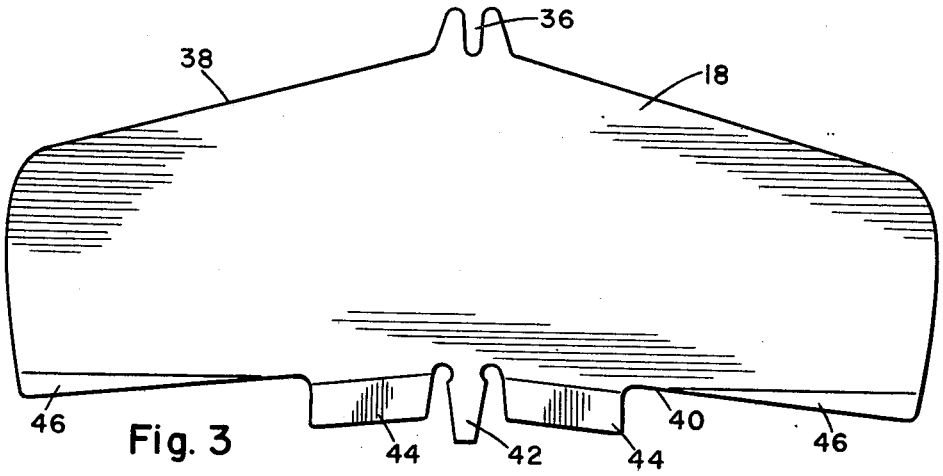
FIG. 3 is a top plan view of the wing.

The glider comprises an elongated fuselage 10 having a nose 12, a central portion 14 and a tail portion 16, and a wing 18 which may be of any convenient planform, as in FIG. 3. Fuselage 10 is made from flat sheet material symmetrical about a longitudinal lower fold line 20 and has aerodynamic stabilizing surfaces integral with the tail portion 16. These include horizontal tail surfaces 22 at the rear end and vertical tail surfaces 24 just forward of the horizontal elements, which latter are bent outwardly on opposite sides. The shapes of the tail surfaces can also vary to represent different types of aircraft.

Figure 1:
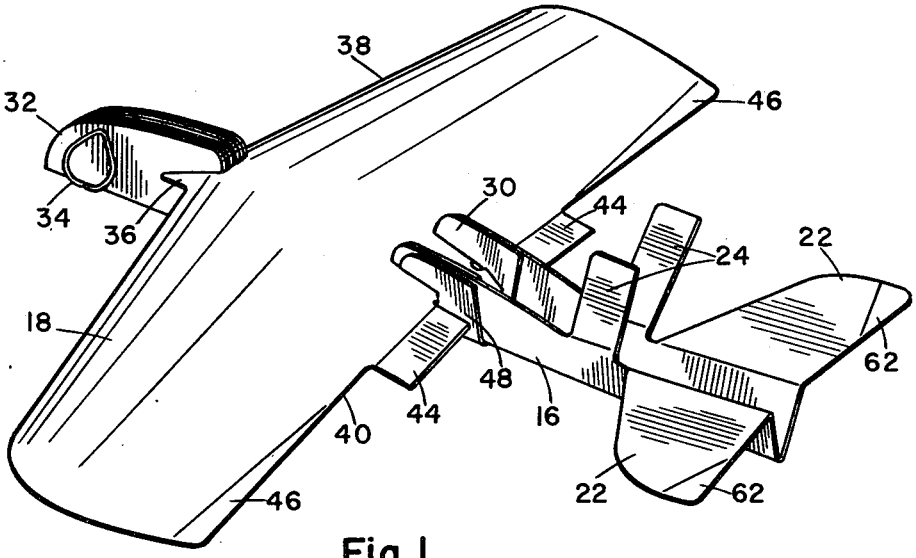
FIG. 1 is a perspective view of the complete glider.
Figure 2:
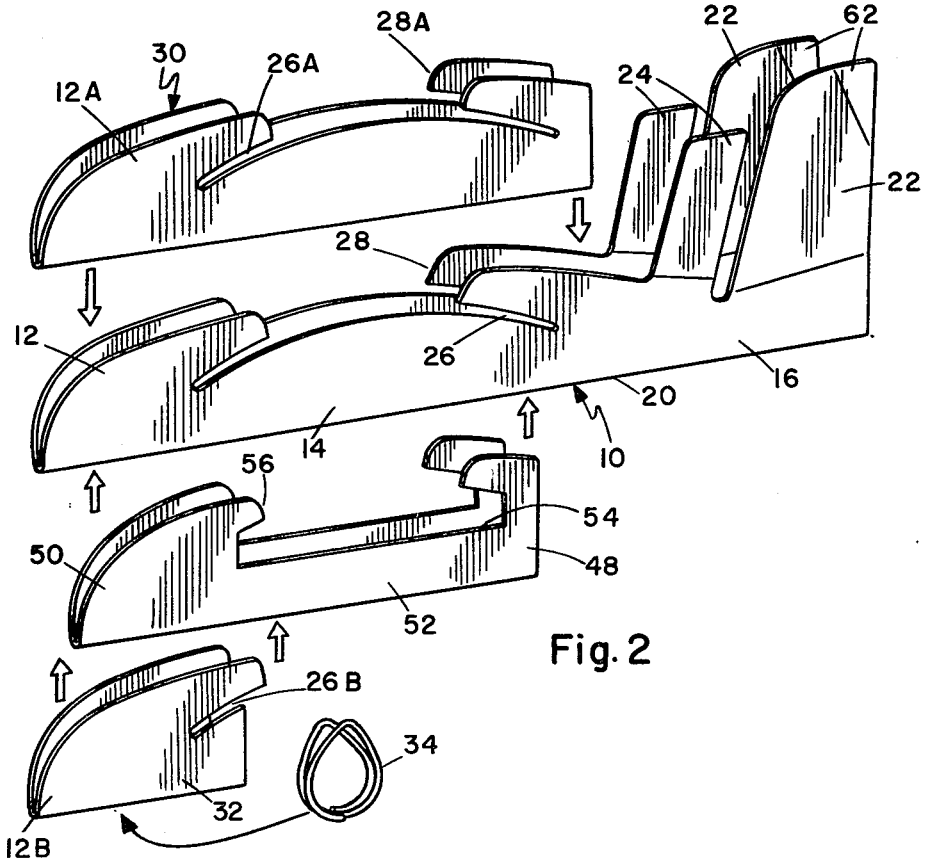
FIG. 2 is an exploded view of the fuselage components.

Central portion 14 has a longitudinally extending curved slot 26 which is upwardly convex, the upper fuselage portion above the slot being cut away to provide an opening 28 shorter than the slot. As illustrated in FIG. 2, the fuselage is reinforced by a coextensive inner reinforcing element 30 and a nose reinforcing element 32. The inner element 30 is similar in all respects to the central and nose portions of the fuselage and corresponding portions are similarly numbered with the suffix A. Nose element 32 corresponds to the nose portion of the fuselage and the parts are similarly numbered with the suffix B. Inner element 30 fits inside the fuselage 10 and nose element 32 fits outside under the nose 12, the multiple layers being held by a clip 34, such as a ring type paper clip.

Wing 18 has a notched key 36 on the center of the leading edge 38, the key straddling the multiple nose portion layers at the forward end of slot 26. At the center of the trailing edge 40 is a rearwardly extending rear key 42, which fits inside the fuselage and inner element 30 adjacent the rear of slot 26. Slot 26 is just deep enough to accommodate the thickness of the wing and holds the wing in a cambered configuration, which improves the lift and provides spanwise stiffness. The two keys align the wing laterally and the rear key spreads the sides of the rear fuselage to give rigidity to the tail portion. On opposite sides of the rear key 42 are small trailing edge flaps 44, and the outer portions of trailing edge 40 are scored to provide outboard flaps or ailerons 46, which are adjustable for flight control.

Slot 26 is longer than the central chord of wing 18 to allow forward and aft adjustment of the wing. The wing is secured at any preset position in the slot by a slidable locking member 48, which fits coextensively on the outside of the fuselage 10 and inside the nose element 32. Locking member 48 is basically similar to the central and forward fuselage, with a nose portion 50, a central portion 52 and a wing slot 54. However, the length of slot 54 is substantially equal to the central chord of wing 18 and thus fits closely on and moves with the wing. Locking member 48 has an opening 56 above slot 54 for insertion of the wing and the slot is of sufficient vertical depth to accommodate the changes of camber in the wing as it is moved along curved slot 26. At any position the locking member 48 is secured between nose 12 and outer nose element 32 by the clip 34.

Figure 4:
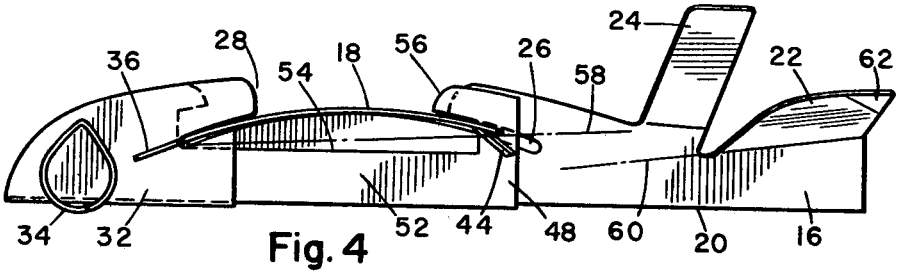
FIG. 4 is a side elevation view of the glider with the wing in the full forward position.

In FIG. 4 the wing is shown in a forward position with the locking member forward. In this position the effective chord line 58 of the wing is almost parallel to the chord line 60 of the horizontal tail surfaces 22. The wing actually has a slight positive incidence relative to the tail, which is a normal configuration for straight stable flight. In this position, in fact, the glider tends to fly in a straight line in a generally level position, but can be deviated by adjustment of the ailerons 46, flaps 44 and the tail surface.

Figure 5:
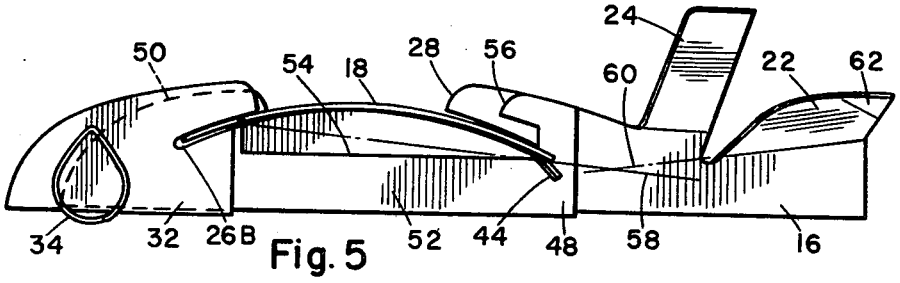
FIG. 5 is a side elevation view with the wing in the full aft position.

In FIG. 5 the wing is shown in the rearmost position, with the locking member displaced rearwardly and secured by clip 34. In this position the effective chord line 58 of the wing is at a large positive angle of incidence relative to the tail chord line 60, which is aerodynamically equivalent to an up elevator setting. The glider thus tends to turn or loop tightly, depending on its orientation at launch. It can, in fact, be thrown in a small area to loop or circle and return to the hand. The multiple layers of the central portion of the fuselage provide the necessary strength for obtaining a good grip when launching.

At various settings between the front and rear positions, the curve of slot 26 causes the wing to change its angle of incidence relative to the tail and thus provide a wide range of aerodynamic adjustments between straight and aerobatic flight. At any position the various control surfaces can be adjusted to modify, enhance, or add to the basic wing setting to obtain a variety of flight characteristics. With the ability to lock the wing in position, a particular performance or flight path can be repeated as often as required, making it possible to demonstrate the glider's capabilities with some consistency.

As mentioned, the clip 34 acts as a nose ballast for balancing the glider, in addition to securing the nose assembly. It would seem, therefore, that moving the wing aft, as in FIG. 5, would effectively lengthen the nose and move the center of gravity forward, which would counteract the tight turning tendencies. It has been found, however, that in a small glider of this type, the aerodynamic relationship between the surfaces is much more powerful than the weight balance. In any event, as the locking member 48 is moved aft, the clip 34 is also moved aft to ensure that the locking member is gripped, so there is a slight rearward shift of the ballast to compensate for the lengthened nose. This can be seen by a comparison of the clip positions in FIGS. 4 and 5. The clip also acts as a protective skid under the nose for landing.

Figure 6:
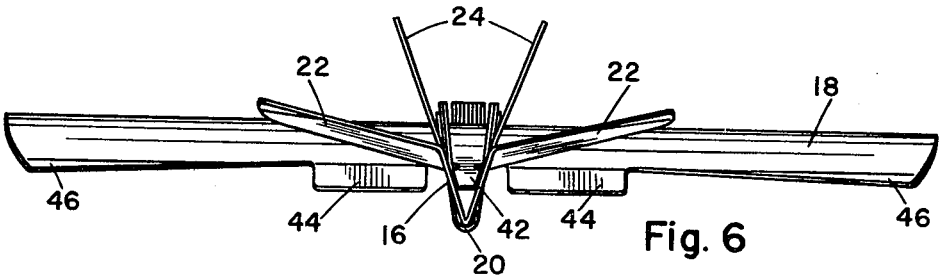
FIG. 6 is a rear view of the glider in the configuration of FIG. 5.

In FIG. 6 the horizontal tail surfaces 22 are shown with a small dihedral angle, while the vertical tail surfaces 24 generally follow the angle of separation of the rear fuselage sides. These positions can, of course, be varied and will have some effect on flight performance. Also the horizontal surfaces can be scored to provide adjustment, rather than bending the entire surfaces. It should also be understood that the structure is applicable to a canard configuration, in which the stabilizing surfaces are ahead of the wing.

The combination of novel features described provides a rugged and versatile glider capable of a wide range of predictable performance.

Having described my invention, I claim:

1. A hand launched glider, comprising:

a wing of substantially flat sheet material;

an elongated fuselage having a nose, a central portion and a tail portion, said central portion having a longitudinally extending, upwardly convexly curved wing receiving slot therein to hold the wing in a cambered configuration;

said wing being longitudinally adjustable in said slot;

a locking member on said fuselage for locking said wing at selected longitudinal positions in said slot, said locking member fitting coextensively on the fuselage and having a wing retaining slot in which the wing is a close longitudinal fit;

retaining means on said fuselage for securing said locking member to the fuselage;

and aerodynamic stabilizing surfaces extending from the fuselage in spaced relation to the wing.

2. A hand launched glider according to claim 1, wherein the upper portions of said fuselage and locking member above the slots have longitudinal openings for insertion of the wing.

3. A hand launched glider according to claim 2, wherein said wing retaining slot has a vertical depth sufficient to clear the wing at all cambered positions in the fuselage slot.

4. A hand launched glider according to claim 3, wherein said locking member has a nose portion coextensive with the fuselage nose, said retaining means comprising a spring clip straddling and frictionally engaging the combined thicknesses of the fuselage and locking member nose portions.

5. A hand launched glider according to claim 4, wherein said locking member is mounted externally on the fuselage;

and including an external nose reinforcing member fitted over said locking member nose portion and secured by said clip.

6. A hand launched glider according claim 4, wherein said fuselage is of sheet material folded longitudinally, said locking member being of sheet material folded longitudinally and straddling the nose and central portion of the fuselage externally.

7. A hand launched glider according to claim 6, wherein said wing has a leading edge and a trailing edge, said locking member engaging both the leading and trailing edges simultaneously within the wing retaining slot.

* * * * *